US005209893A

United States Patent [19]

Askin et al.

[11] Patent Number: 5,209,893

[45] Date of Patent: May 11, 1993

[54] ADJUSTABLE BURNER INSERT AND METHOD OF ADJUSTING SAME

[75] Inventors: Kerim Askin; John D. Butler, both of Carroll County, Ga.

[73] Assignee: Southwire Company, Carrollton, Ga.

[21] Appl. No.: 794,091

[22] Filed: Nov. 18, 1991

[51] Int. Cl.[5] ..... C22B 9/16

[52] U.S. Cl. ..... 266/47; 266/223; 266/266; 431/186; 431/189

[58] Field of Search ..... 266/47, 223, 218, 266; 431/186, 189

[56] References Cited

U.S. PATENT DOCUMENTS

| | | | |
|---|---|---|---|
| 941,833 | 11/1909 | Williams . | |
| 1,321,996 | 11/1919 | Dreffein . | |
| 1,469,326 | 10/1923 | Mahr . | |
| 2,360,548 | 10/1944 | Conway | 158/117.5 |
| 3,220,803 | 11/1965 | Billi | 23/277 |
| 3,533,717 | 10/1970 | Guerin | 431/182 |
| 4,154,571 | 5/1979 | Pariani | 431/186 |
| 4,156,590 | 5/1979 | Pariani | 431/3 |
| 4,262,371 | 4/1981 | Berry et al. | 4/191 |
| 4,301,997 | 11/1981 | Berry et al. | 266/236 |
| 4,473,350 | 9/1984 | Gitman | 431/160 |
| 4,493,271 | 1/1985 | Ohayon et al. | 431/186 |
| 4,865,297 | 9/1989 | Gitman | 266/266 |
| 5,071,105 | 12/1991 | Donze et al. | 266/100 |

*Primary Examiner*—Melvin J. Andrews

*Attorney, Agent, or Firm*—Stanley L. Tate; James W. Wallis, Jr.; George C. Myers, Jr.

[57] ABSTRACT

An improved premix-type burner for a gas-fired metal processing furnace includes a burner insert externally adjustable over a stepless continuum. The burner insert includes a helical thread disposed on its outer diameter which cooperatively engages with a helical thread disposed on an inner diameter of the burner body bore. Rotation of an adjustment tube, which extends into the burner body and is affixed to the burner insert concentrically disposed therein, causes axial translation of the burner insert, thereby regulating fuel flow to the combustion chamber and controlling the combustion process.

22 Claims, 4 Drawing Sheets

ADJUSTABLE BURNER INSERT AND METHOD OF ADJUSTING SAME

FIELD OF THE INVENTION

The present invention relates to metal processing furnaces, and more particularly to a furnace burner adjustment apparatus which is particularly adapted for use in gas-fired furnaces in which various materials, such as metals or their alloys, are processed.

DESCRIPTION OF THE PRIOR ART

Modern metal melting and holding furnaces utilize liquid or gaseous fuels which are delivered, usually in combination with an oxidant, to a plurality of burners which are directly exposed to the material to be processed. Furnaces designed for the processing of metals may operate within a relatively wide range of temperatures related to any of the various metal processing stages and the particular metal or metal alloy to be processed. These processing furnaces are often uniquely configured with a variety of burner arrays installed therein, to provide the required heating characteristics. For example, vertical shaft type furnaces for melting metal are well known in the art, as typified by the furnace disclosed in U.S. Pat. No. 4,301,997 which is assigned to the assignee of this invention. Selection of an appropriate furnace/burner configuration, and a fuel-/oxidant combination are important factors in the resulting furnace environment, as is the control of each individual burner.

Most modern gas-fired metal processing furnaces are heated by passing a specified mass flow of a pressurized mixture of fuel and an oxidant, usually air, through a metered orifice to the combustion chamber of each furnace burner. The mixture is ignited by an appropriate ignition system, causing steady state combustion of that mass flow within the refractory-lined combustion chamber of the furnace. Burner temperature as well as flame propagation and stability varies with fuel composition, fuel-air ratio, fuel mixture delivery pressure, orifice throat length and diameter and the resulting flow characteristics, as well as the combustion chamber characteristics. Accordingly, a measurable change in any of these parameters may cause a related and undesirable variation in temperature or other operating characteristic within the furnace. In particular, flame propagation and stability characteristics and associated burner noise levels are critically affected by orifice throat length and diameter.

According to the prior art, one method of establishing acceptable burner performance, including stable flame characteristics at relatively low noise levels, is by incrementally varying the effective orifice throat length of the burner insert which extends axially from a fixed intermediate location within the burner body to a burner insert outlet which is open to the furnace side of the burner. As is well known in the art, variation of the axial location of the furnace side of the burner insert relative to a combustion zone in the refractory-lined combustion chamber results in a variation of fuel mixture flow characteristics.

According to the prior art, the appropriate orifice throat length is achieved by first shutting down the furnace and allowing it to cool, disconnecting a burner pipe assembly from its mounting in the furnace wall, removing the fixedly-retained insert located therein, welding a length of nipple onto or cutting a length of nipple off of the furnace side of the burner insert or replacing the nipple with a nipple having a different length and inside diameter to create a new orifice throat length and diameter, followed by reassembly of the insert and burner apparatus in reverse order. This procedure is repeated as necessary in a time-consuming, trial-and-error fashion, until acceptable flame and low noise characteristics have been obtained. This disassembly/welding or replacement/reassembly routine necessary for the adjustment of each burner highlights a number of impediments to an efficient modern day metal processing furnace operation.

First, the process of obtaining a satisfactory orifice throat length and diameter for each of the plurality of burners in a typical furnace application is time consuming. Second, precise manufacture of a burner insert having a satisfactorily operable orifice throat length and diameter is an inexact process at best which does not guarantee optimal burner performance. Third, misadjustment of one or more burner assemblies during initial or continuing furnace operation can result in unacceptable noise levels caused by resonance of one or more burners at particular fuel mixture flow and delivery pressure conditions.

SUMMARY OF THE INVENTION

It is therefore an object of the present invention to provide an adjustable burner apparatus for a gas-fired metal processing furnace, wherein the adjustment apparatus includes a burner insert which is rapidly adjustable from a point external of the furnace and burner apparatus.

It is another object of the present invention to provide a burner insert for a gas-fired metal processing furnace which is precisely and rapidly adjustable over a stepless continuum from a point external of the furnace and burner apparatus.

It is yet another object of the present invention to eliminate the need to shut down the furnace and disassemble the burner during the course of orifice throat length and diameter adjustment.

It is a further object of the present invention to provide an on-line method and means to attenuate or eliminate unacceptable noise levels caused by the harmonic resonance of misadjusted furnace burners.

The present invention provides an adjustable burner insert apparatus for a metal processing heating furnace which utilizes a liquid or gaseous fuel mixed with an oxidant, usually air. Integration of this apparatus into such a furnace facilitates speedy adjustment of each of the plurality of burners, generally ranging in number from five to thirty-two, typically found on most modern metal processing furnaces by providing means for adjusting in rapid and precise fashion the orifice throat length and diameter of each burner without necessitating furnace shut down and the dismantling and adjustment procedures of the prior art. In particular, the invention allows for the precise external control of orifice throat length in one embodiment, in which a stepless continuum of adjustment is provided by a helically threaded engagement between the burner housing and a concentrically disposed axially extending burner insert which translates therethrough.

In another embodiment, stepless adjustment of the orifice throat length is provided by a telescoping axially extending access tube affixed to the burner insert, the access tube secured by a gland nut disposed proximate to a peep sight located at the external terminus of the burner body. In like manner, each burner may be further tuned to eliminate those burner resonances which are known to occur at particular fuel mixture flow and delivery pressure conditions. In a further embodiment, the inner diameter of the burner insert is further modified by the addition of a nesting shaped element which enables further adjustment of fuel mixture flow characteristics. A novel method of operating the burners of a metal processing furnace to control the burner flame and noise is disclosed and characterizes an appropriate adjustment procedure. Accordingly, the flame and noise characteristics of any given burner may be precisely controlled and expeditiously adjusted to a degree heretofore unknown in the art.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
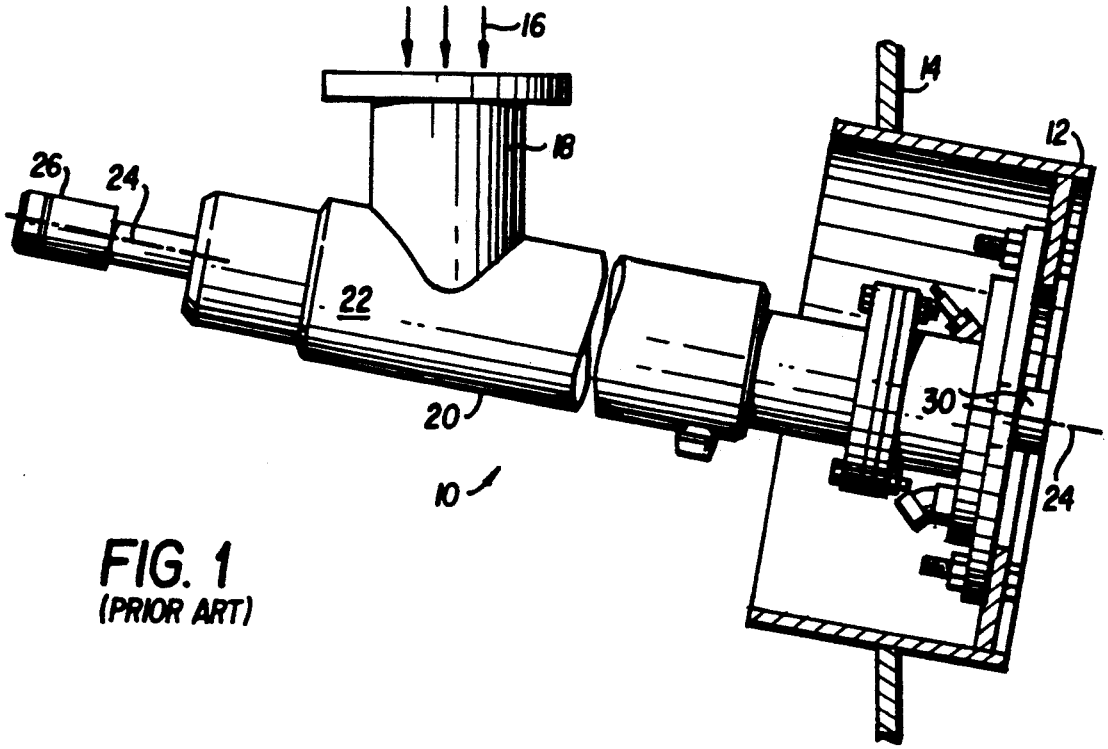
FIG. 1 (PRIOR ART)
FIG. 1 is a side view, partly in cross-section, of a prior art gas burner apparatus assembly as installed in a burner port in a metal processing furnace.

Referring now in detail to the drawings wherein like parts are designated by like reference numerals throughout, there is illustrated in FIG. 1 a side view of a prior art gas burner apparatus 10 as installed through a burner port 12 in the wall 14 of a metal processing furnace (not shown), such as a vertical shaft furnace for melting metal of the type disclosed in U.S. Pat. No. 4,301,997. In particular, operation of the gas burner 10 is accomplished by feeding a fuel/air mixture 16 through a fuel/air inlet 18 which opens into the bore 20 of a water-cooled burner body 22 having a longitudinal axis 24. A peep sight 26 is located at the outermost end of the burner body 22 for viewing the condition of the burner flame in the furnace along the longitudinal axis 24 of the gas burner 10.

Figure 2:
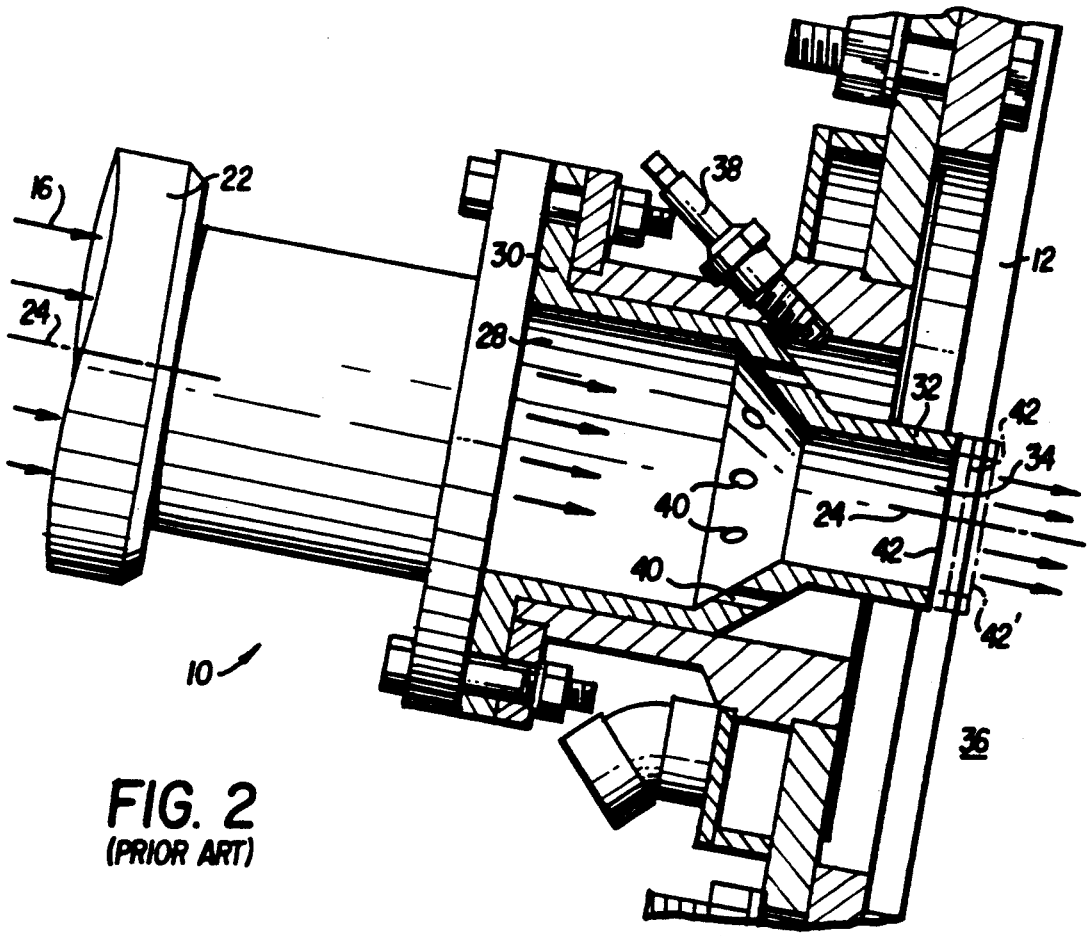
FIG. 2 (PRIOR ART)
FIG. 2 is an enlarged fragmentary side view, partly in cross-section, of the prior art burner apparatus of FIG. 1.

Now referring to FIG. 2, the fuel/air mixture 16 is then directed through the burner body 22 in a direction generally along the axis 24 into a throat 28 of a shaped burner insert 30. The mixture 16 then exits the insert 30 through a nipple 32 of a burner insert orifice 34 integrally formed with the insert 30 and flows into a fixed combustion chamber 36 of the furnace, where it is combusted and forms a burner flame. Initial lighting of the burner 10 is accomplished by an ignition means, such as a spark plug 38, which ignites the combustible mixture 16 as it flows through ports 40.

According to the prior art, satisfactory flame conditions within the combustion chamber 36 are achieved by varying the point at which the fuel/air mixture 16 exits the insert 30, i.e., the location of the free or combustion end 42 of the insert 30 along the longitudinal axis 24, indicated by phantom lines 42'. However, because the prior art burner insert 30 and its exit end 42 (or 42,) are fixedly located with respect to the burner port 12 and furnace wall 14 (FIG. 1), delivery of the fuel/air mixture 16 to a precise exit location within the combustion chamber 36 requires that an incremental length of nipple 32 be welded to or removed from the exit end 42 of the insert 30 in a time consuming, trial-and-error fashion or that a plurality of inserts 30 having nipples 32 of several different lengths be maintained in a parts inventory. The resulting fixed orifice throat length is equal to the serially connected longitudinal flow path disposed through the burner insert 30 and nipple 32 to the exit end 42 thereof.

Figure 3:
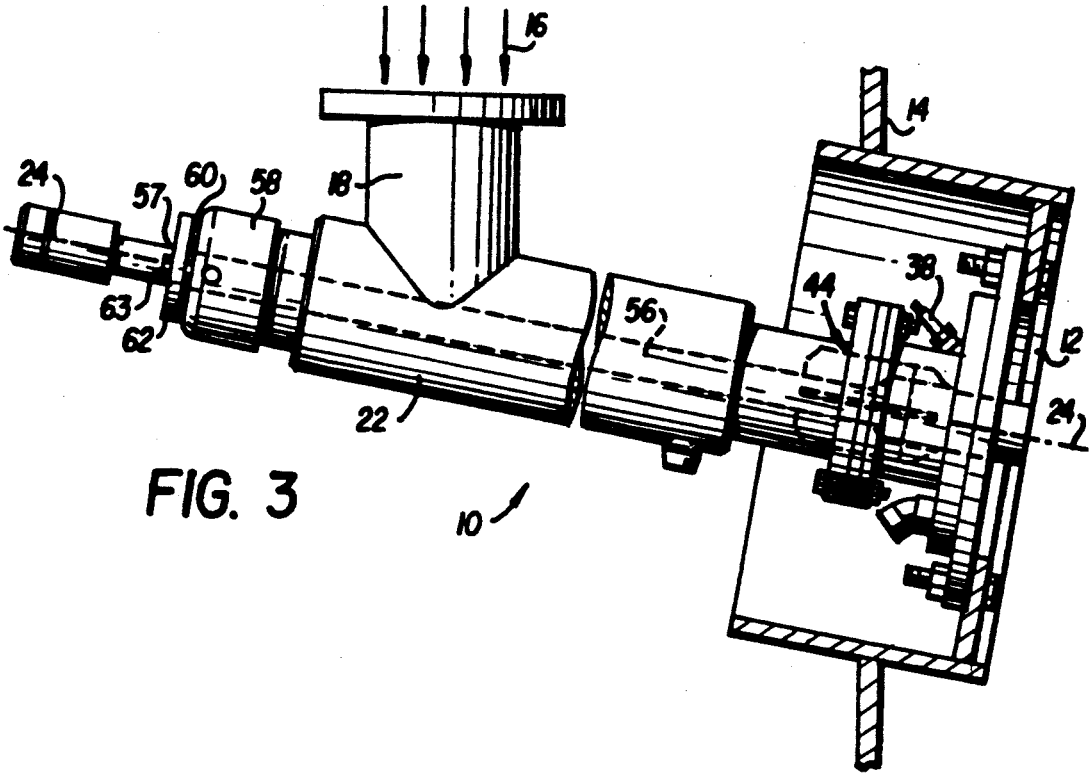
FIG. 3 is a side view, partly in cross-section, of the adjustable gas burner apparatus assembly of the present invention as installed in a burner port in a metal processing furnace.

Now referring to FIG. 3, the adjustable burner assembly 10 of the present invention is installed through a burner port 12 in a wall 14 of a metal processing furnace (not shown). According to the invention, the fuel/air mixture 16 is fed through the fuel/air inlet 18 of the water-cooled burner body 22 having a longitudinal axis 24 and is directed therethrough to a shaped burner insert 44.

Figure 4A:
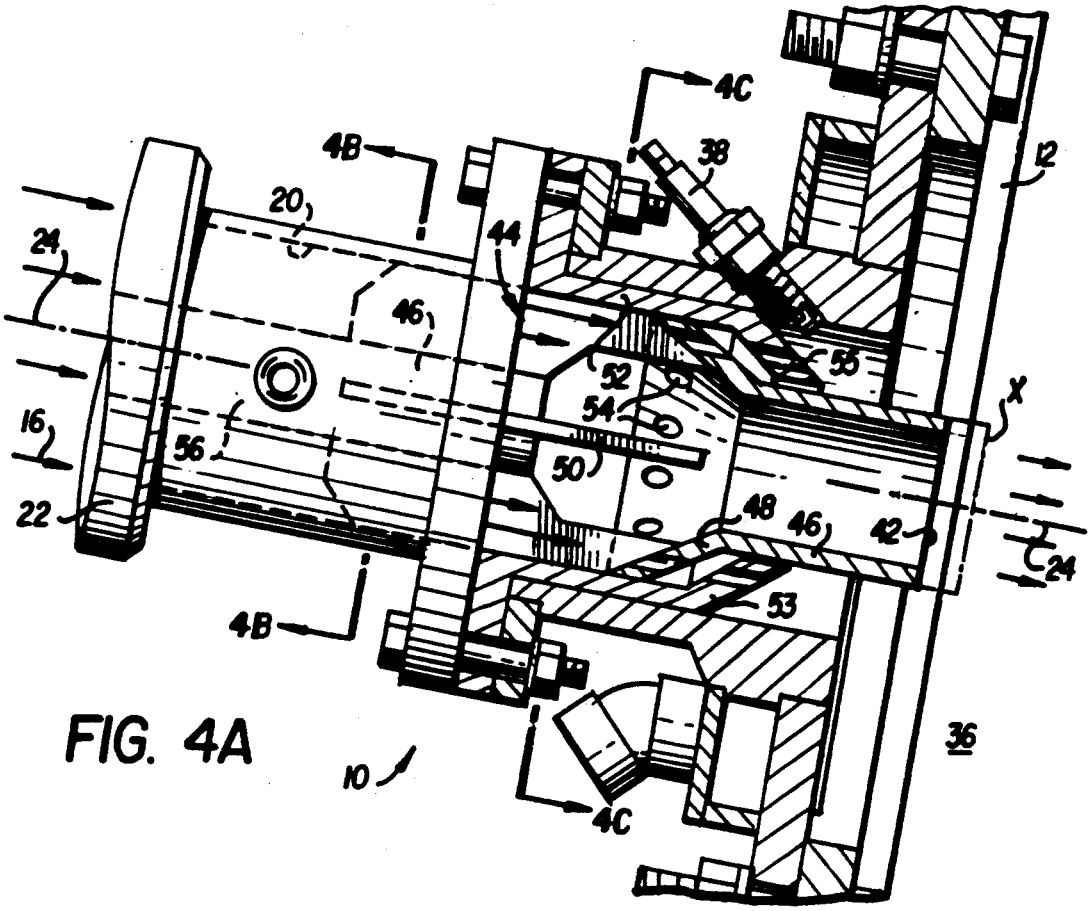
FIG. 4A is an enlarged fragmentary side view, partly in cross-section, of one embodiment of the adjustment apparatus of the present invention.
Figure 4B:
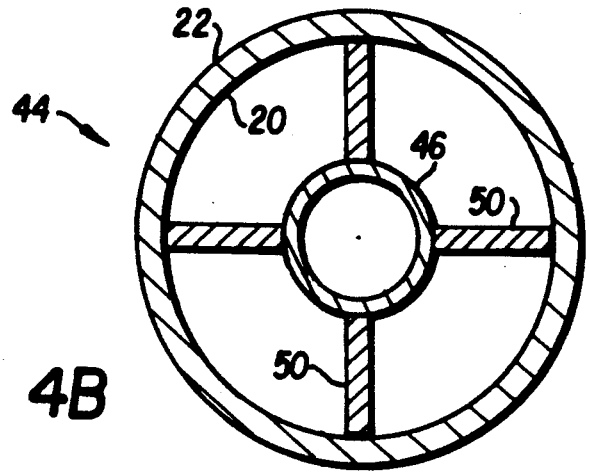
FIG. 4B is an axially outward cross-sectional view of the adjustment apparatus of FIG. 4A taken along line 4B—4B.
Figure 4C:
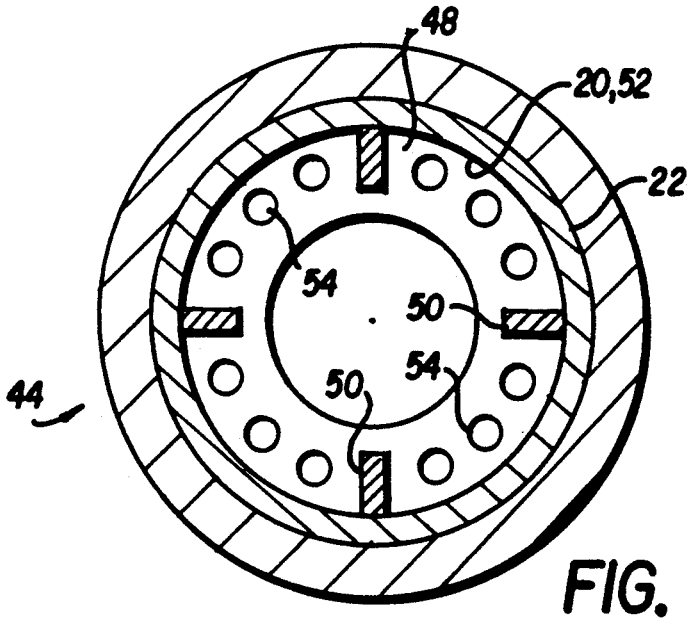
FIG. 4C is an axially inward cross-sectional view of the adjustment apparatus of FIG. 4A taken along line 4C—4C.

As best seen in FIGS. 4A–4C the burner insert 44 is comprised of an axially extending tubular member 46 integrally formed with a truncated conical member 48 and is concentrically disposed within the bore 20 of the burner body 22. The insert 44 also has a plurality of angularly-spaced apart radial fins 50 welded or otherwise affixed to the conical member 48. Fins 50 terminate at their outermost radial surfaces with a clearance fit at the bore 20 of the burner body 22 (FIG. 4B). According to this embodiment, the fins 50 are arranged at 90° intervals about the axis of the insert 44 with each fin 50 extending longitudinally along the bore 20. The fin 50 are welded at their innermost radial surfaces to a tube 56 which extends along the axis 24 through the burner body 22. The insert 44 is guided in the bore 20 and in a sleeve 52 which has a truncated conical portion 53 through which the tubular member 46 extends. Conical portion 53 has a plurality of holes 55 disposed annularly therearound.

The fuel/air mixture 16 is directed in the general direction of the longitudinal axis 24 of the burner body 22 through the spaces defined by the fins 50 and the inner walls of the bore 20 and sleeve 52. The mixture 16 then flows through the conical member 48 and tubular member 46 into the combustion chamber 36 where it is combusted. Combustion is initiated as in the prior art by the ignition means 38. The mixture 16 flows through pilot holes 54 annularly disposed through the conical member 48 and thence through holes 55 in conical portion 53 to the ignition means 38 during initial burner lighting.

The point at which the fuel/air mixture 16 exits from the furnace end 42 of the burner insert 44 relative to the burner port 12 is determinative of subsequent burner performance, as previously described. According to the embodiment of the present invention shown in FIG. 3, this adjustment is enabled by the cylindrical adjustment tube 56, the inner end of which is affixed to the burner insert 44, and the outer end of which passes through a threaded cap 58, an elastomeric gasket 60 and flange 62. Gasket 60 is adapted to seal around and grip the end of tube 56 extending through cap 58. After the adjustment tube 56, and hence the burner insert 44, has been slidably adjusted to the proper position along axis 24, flange 62 is urged by two or more bolts 63 against the elastomeric gasket 60 to cause the gasket to circumferentially grip and secure the tube 56 and the burner insert 44 in the desired adjusted position.

Figure 5:
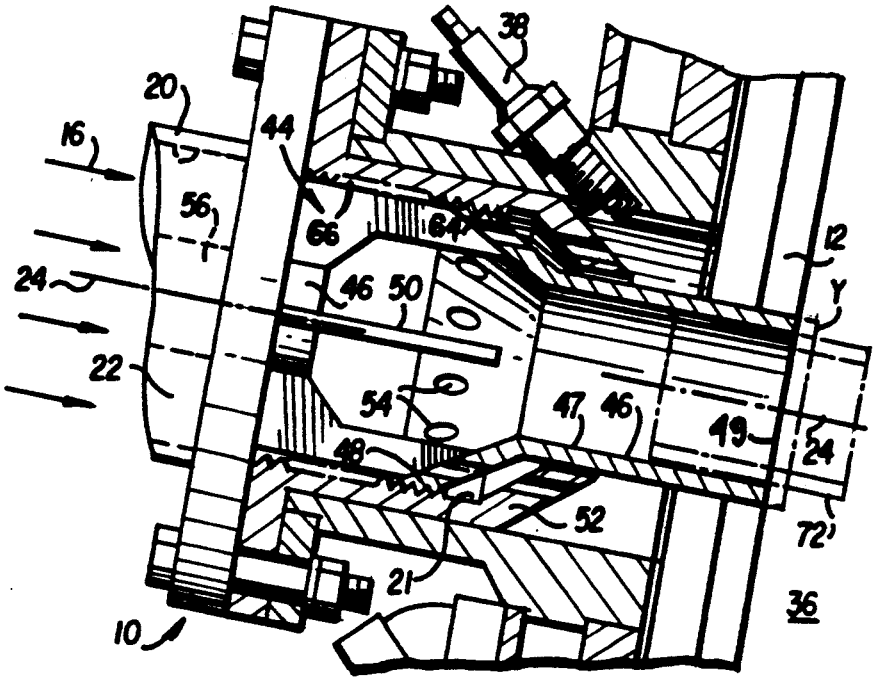
FIG. 5 is an enlarged fragmentary side view, partly in cross-section, of another embodiment of the adjustment apparatus of the present invention.

Now referring to FIG. 5, another embodiment of the adjustable gas burner apparatus 10 of the present invention is shown. The burner insert 44, which comprises substantially the same tubular member 46, conical member 48, and fins 50, previously described in connection with FIGS. 4A–4C, has a helical thread 64 concentrically disposed on the outer circumference of the conical member 48 and at least a portion of the fins 50. The helical thread 64 is threadably engaged with a corresponding helical thread 66 formed on the internal bore 21 of sleeve 52. Rotation of cylindrical adjustment tube 56 enables precise axial adjustment of the burner insert 44 so that the exit end 49 of tubular member 46 can be positioned in the proper location relative to burner part 12.

Figure 6A:
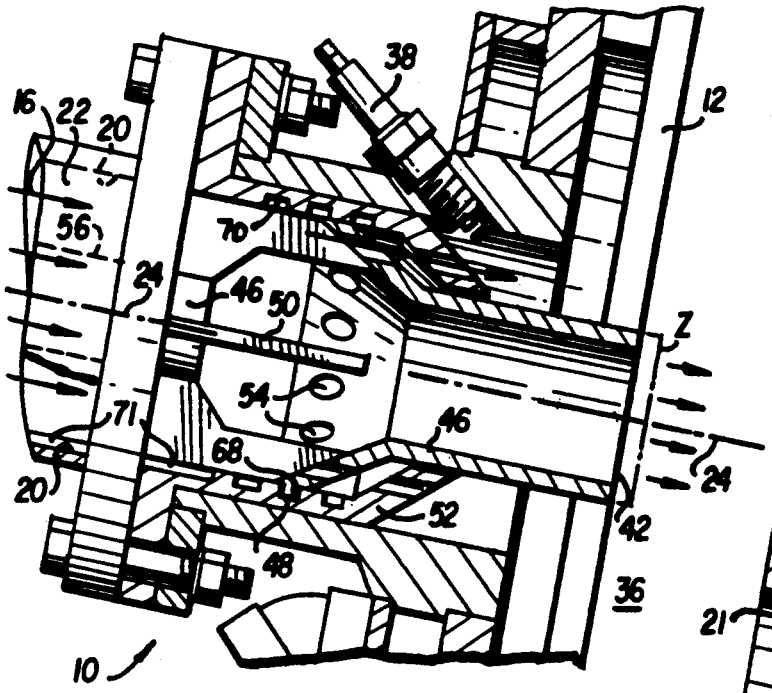
FIG. 6A is an enlarged fragmentary side view, partly in cross-section, of yet another embodiment of the adjustment apparatus of the present invention.
Figure 6B:
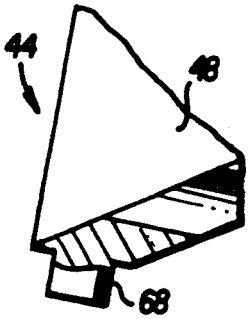
FIG. 6B shows the configuration of the helical groove of FIG. 6A.
Figure 6C:
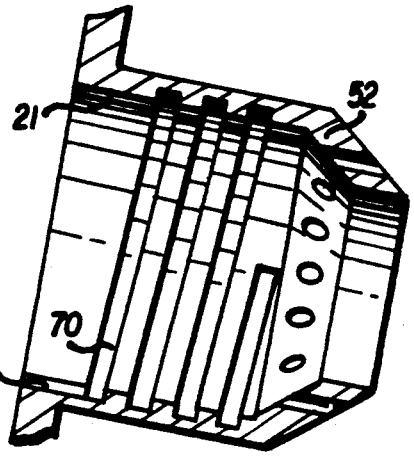
FIG. 6C shows the configuration of the pin of FIG. 6A.

Alternatively, a pin and groove arrangement may be employed to achieve the objects of the invention as shown in FIGS. 6A–6C. According to this alternative embodiment, a radially outwardly extending pin 68 disposed on the burner insert 44, shown in detail in FIG. 6B, engages with a helical groove 70 formed in the inner surface of the bore 21 of the sleeve 52, shown in detail in FIG. 6C. The radially outwardly extending pin 68, which extends from the conical member 48 is introduced to the helical groove 70 at a keyeway 71 formed in the bores 20 and 21.

A choice of one adjustment configuration over another will involve a consideration of various furnace operating conditions. By way of example only, the furnace operating environment typically includes potentially corrosive byproducts, such as gaseous and liquid combustion chamber byproducts, including condensation products which occur during shutdown periods of the furnace. Some of these byproducts inevitably aggregate in the burner components including the threads 64, 66 and groove 70 of the burner. In view of the quantity and composition of such byproducts, and the degree those byproducts may be present in the adjustable components of the present invention, a particular one of the above-described embodiments may be selected. In like manner, a particular adjustment configuration or an equivalent may be chosen so as to cooperatively accommodate various material properties of the individual elements of the threaded engagement, such as thermal coefficient of expansion, ductility and corrosion fatigue, among others.

In any embodiment shown in FIGS. 5 and 6A–6C, external adjustment of the burner insert 44 is enabled by the hollow adjustment tube 56 which extends through the burner body 22 to a tube terminus 57 external to the burner body 22. Rotation of the tube 56 by a torsional input applied to the tube terminus 57 by a suitable gripping means causes axial translation of the burner insert 44 along the longitudinal axis 24 relative to the combustion chamber 36, thereby altering the axial position of the exit end 49 of the insert 44 as shown by the phantom line Y in FIG. 5 and by the phantom line Z in FIG. 6A. Accordingly, rapid and precise axial adjustment of the burner insert 44 by axially sliding (FIGS. 3 and 4A–4C) or rotating (FIGS. 5 and 6A–6C) the access tube 56 allows for the accommodation of changed furnace conditions as well as for the fine tuning of the burners at those conditions.

For any of the embodiments of the present invention thus far described and shown, further adjustment of fuel mixture delivery characteristics may be accomplished by the interference fitting of a tubular sleeve insert 72 into the bore 47 of the tubular member 46, as shown in phantom lines in FIG. 5. The insert 72, which may have an inner diameter ranging from 1⅜ inch to 1¾ inch, is fitted into the tubular member bore 47 after the burner insert and adjustment tube assembly 44, 56 has been axially withdrawn from the burner body 22.

Accordingly, the orifice throat length of the burner 10 is axially adjustable over a stepless continuum, due to the axial adjustability offered by the axially slidable or threadable engagement of the burner insert 44 within the bore 20 of the burner body 22, thereby offering a number of important control, and, ultimately, process benefits. Among these benefits includes the ability to precisely establish required combustion chamber parameters when the burner flame itself is visually observed by an experienced furnace operator as one indicator of burner performance. This ability may be realized by, for example, employing the access tube 56 as a viewing port for observing the burner flame in the combustion chamber 36 and making adjustments in current furnace operating conditions by using the adjustment apparatus of the present invention. If desired, the tube terminus 57 of the embodiments of FIGS. 5 and 6A–6C may be provided with an hexagonal outer portion for engagement by a wrench to facilitate rotation of the tube 56 and thereby axial adjustment of the burner insert 44.

A variety of fuel mixtures 16 may be directed to the gas burner apparatus 10, in some burner configurations already premixed with an oxidant upstream of the fuel/air inlet 18. Ideally, a stoichiometric fuel/air mixture is obtainable for steady state, efficient, low-noise combustion.

The burner adjustment apparatus 10 of the present invention provides yet another advantage in the operation of a metal processing furnace. An important problem in the operation of metal processing is that of noise generation. One noise source often encountered is the high frequency noise generated by a misadjusted burner upon its initial lighting or the noise caused by the resonance of multiple burners operating at particular fuel/air flow and pressure conditions. According to the rapid and precise adjustment capability of the present invention, excessive noise levels can be quickly eliminated without necessitating furnace shutdown and adjustment procedures of the prior art.

One method of operating the apparatus of the present invention includes initially establishing the burner insert 44 at an approximately intermediate position relative to its overall length of travel. Preferably, the initial setting of the insert 44 is at a predetermined position having an initial orifice throat length which will provide a sufficient flow of a fuel/air mixture 16 to the ignition source 38 to support initial combustion. After initial flame propagation, the adjustment tube 56 is rotated about the longitudinal axis 24 to alter the orifice throat length as necessary to provide stable, steady state burner operation. During the ignition procedure, the furnace operator views the resulting burner flame through the adjustment tube 56 and adjusts the orifice throat length as necessary to provide that fuel/air mixture delivery which results in a desired flame. Further adjustment of the throat length may be readily achieved in a like manner when various changes in burner operating parameters such as fuel/air composition, delivery pressure or temperature requirements, among others, occurs. In accordance with the above, it follows that the method of adjustment of the present invention as herein described and claimed is readily amenable to remote and/or automated feedback control.

Although certain presently preferred embodiments have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A burner apparatus for a metal processing furnace comprising a burner body having an axial bore therethrough and an inlet for supplying a premixed gaseous fuel to the base of the burner body, the bore of said burner body having an outlet into said furnace, a burner insert disposed in said bore adjacent said outlet, said premixed fuel flowing from said inlet through said burner insert and into the furnace for combustion and means coupled to the burner insert and operable from outside the burner body for adjusting the axial position of the burner insert in relation to the outlet whereby the point at which the premixed gaseous fuel flows into the furnace can be varied to thereby alter the performance of the burner during operation of the furnace.

2. The burner apparatus of claim 1, wherein said adjusting means for the burner insert comprises an adjustment tube connected at one end to the burner insert, the other end of said adjustment tube extending out of the burner body.

3. The burner apparatus of claim 2, wherein said burner insert is axially slidable in said bore by means of said adjustment tube and means on said burner body for securing said adjustment tube against axial movement so as to fix the position of the burner insert in the bore.

4. A burner apparatus for a metal processing furnace comprising a burner body having an axial bore therethrough and an inlet for supplying a premixed gaseous fuel to the base of the burner body, the bore of said burner body having an outlet into said furnace, a burner insert disposed in said bore adjacent the outlet through which the premixed fuel flows into the furnace for combustion, means coupled to the burner insert and operable from outside the burner body for adjusting the axial position of the burner insert in relation to the outlet whereby the performance of the burner may be altered during operation of the furnace, said adjusting means for the burner insert comprising an adjustment tube connected at one end to the burner insert, the other end of said adjustment tube extending out of the burner body, said burner insert being axially slidable in said bore by means of said adjustment tube and means on said burner body for securing said adjustment tube against axial movement so as to fix the position of the burner insert in the bore, said securing means comprising a gasket surrounding said tube and a collar means for compressing said gasket into gripping relation with the tube.

5. A burner apparatus for a metal processing furnace comprising a burner body having an axial bore therethrough and an inlet for supplying a premixed gaseous fuel to the base of the burner body, the bore of said burner body having an outlet into said furnace, a burner insert disposed in said bore adjacent the outlet through which the premixed fuel flows into the furnace for combustion, means coupled to the burner insert and operable from outside the burner body for adjusting the axial position of the burner insert in relation to the outlet whereby the performance of the burner may be altered during operation of the furnace, said adjusting means for the burner insert comprising an adjustment tube connected at one end to the burner insert, the other end of said adjustment tube extending out of the burner body, said burner insert and said bore being provided with mating helical threads, whereby said burner insert is axially adjustable in said bore by rotation of the burner insert by means of the adjustment tube.

6. A burner apparatus for a metal processing furnace comprising a burner body having an axial bore therethrough and an inlet for supplying a premixed gaseous fuel to the base of the burner body, the bore of said burner body having an outlet into said furnace, a burner insert disposed in said bore adjacent the outlet through which the premixed fuel flows into the furnace for combustion and means coupled to the burner insert and operable from outside the burner body for adjusting the axial position of the burner insert in relation to the outlet whereby the performance of the burner may be altered during operation of the furnace, said adjusting means for the burner insert comprising an adjustment tube connected at one end to the burner insert, the other end of said adjustment tube extending out of the burner body, said burner bore having a helical groove, and a pin on said burner insert engagable in said groove, whereby said burner insert is axially adjustable in said bore by rotation of the burner insert by means of the adjustment tube.

7. A burner apparatus for a metal processing furnace comprising a burner body having an axial bore therethrough and an inlet for supplying a premixed gaseous fuel to the base of the burner body, the bore of said burner body having an outlet into said furnace, a burner insert disposed in said bore adjacent the outlet through which the premixed fuel flows into the furnace for combustion and means coupled to the burner insert and operable from outside the burner body for adjusting the axial position of the burner insert in relation to the outlet whereby the performance of the burner may be altered during operation of the furnace, said adjusting means for the burner insert comprises an adjustment tube connected at one end to the burner insert, the other end of said adjustment tube extending out of the burner body, said burner insert comprising a tubular member integrally formed with a truncated conical member, said tubular member comprising a throat through which the premixed gaseous fuel flows into the furnace for combustion.

8. The burner apparatus of claim 7, including a plurality of radial fins connecting said conical member to the adjustment tube.

9. The burner apparatus of claim 7, including a plurality of pilot holes through said conical member in angularly spaced relation.

10. The burner apparatus of claim 7, wherein said tubular member has a predetermined inside diameter and including a tubular insert fitted to said tubular member to decrease the inside diameter thereof.

11. The burner apparatus of claim 2, wherein said adjustment tube has a longitudinal axis and a central bore through which the burner flame in the combustion chamber may be viewed, the longitudinal axis of said tube being straight from end to end and parallel to the axis of the burner insert.

12. A burner insert for a premixed gaseous fuel burner apparatus for use in a metal processing furnace comprising a tubular member having a throat through which the premixed fuel passes, the throat having an axis, a truncated conical member integrally formed with said tubular member, a plurality of radial fins connected to the conical member, an elongated adjustment tube connected to the radial fins, said tube having a bore with an axis substantially coincident with the throat axis.

13. The burner insert of claim 12, including a helical thread formed on the outermost periphery of the conical member.

14. The burner insert of claim 13, wherein said helical thread is formed on the outermost peripheries of the fins.

15. A burner apparatus for a metal processing furnace having a combustion chamber fired by a premixed gaseous fuel comprising a burner body having a fuel inlet and a fuel outlet and a central bore communicating said inlet with said outlet, a burner insert disposed in said bore for axial adjustment in said bore, said insert comprising a tubular member, a plurality of radial fins connected to the conical member, an elongated adjustment tube connected to the radial fins, said tube having a bore with an axis substantially coincident with the throat axis, and means cooperating between said burner body and said burner insert for adjusting the axial position of said tubular member in said central bore.

16. The burner apparatus of claim 15, wherein said adjusting means comprises mating helical threads formed on the burner insert and the central bore of the burner body.

17. The burner apparatus of claim 15, wherein said adjusting means comprises a helical groove formed on the central bore of the burner body and a pin formed on the burner insert and engaging in the helical groove.

18. The burner apparatus of claim 15, wherein said adjusting means comprises a gasket surrounding said adjustment tube and a collar means for compressing said gasket into gripping relation with the adjustment tube.

19. A method of operating a burner apparatus for a metal processing furnace having a combustion chamber fired by a premixed gaseous fuel comprising a burner body having a fuel inlet and an outlet and a central bore communicating said inlet with said outlet, a burner insert disposed in said bore, said burner insert having a tubular member with a throat through which the premixed gaseous fuel passes, an adjustment tube connected to said tubular member and extending out of the burner body exterior to the furnace, the method comprising:

inserting a burner insert in the central bore of the burner body;

directing a flow of premixed gaseous fuel into the inlet of the burner body;

igniting the fuel passing through the throat of the burner insert to create a flame in the combustion chamber, and manipulating the adjustment tube from outside the furnace during operation thereof to adjust the axial position of the tubular member in the central bore.

20. The method of claim 19, including the step of viewing the burner flame through the adjustment tube.

21. The method of claim 19, wherein said manipulating step comprises rotating the adjustment tube.

22. The method of claim 19, wherein said manipulating step comprises axially sliding said adjustment tube in the central bore.

* * * * *